US011375798B2

(12) United States Patent
Yachya

(10) Patent No.: US 11,375,798 B2
(45) Date of Patent: Jul. 5, 2022

(54) BANGLE AND MAKEUP KIT COMBINATION ASSEMBLY

(71) Applicant: Amelia Yachya, Jakarta (ID)

(72) Inventor: Amelia Yachya, Jakarta (ID)

( * ) Notice: Subject to any disclaimer, the term of this patent is extended or adjusted under 35 U.S.C. 154(b) by 0 days.

(21) Appl. No.: 17/378,431

(22) Filed: Jul. 16, 2021

(65) Prior Publication Data

US 2022/0053915 A1 Feb. 24, 2022

Related U.S. Application Data

(60) Provisional application No. 63/052,732, filed on Jul. 16, 2020.

(51) Int. Cl.

| | |
|---|---|
| ***A45D 40/00*** | (2006.01) |
| ***A45D 40/24*** | (2006.01) |
| ***A45D 42/00*** | (2006.01) |

(52) U.S. Cl.

CPC ..... *A45D 40/24* (2013.01); *A45D 42/00* (2013.01); *A45D 2040/0012* (2013.01); *A45D 2200/25* (2013.01)

(58) Field of Classification Search

CPC ..... A45D 33/33; A45D 2034/007; A45D 2040/0012; A44C 15/002; A44C 5/003

See application file for complete search history.

(56) References Cited

U.S. PATENT DOCUMENTS

| | | | | |
|---|---|---|---|---|
| 1,975,507 | A * | 10/1934 | Hackel | A44C 5/003 132/297 |
| 2,796,747 | A * | 6/1957 | Ebert | A44C 5/003 63/19 |
| 3,559,854 | A * | 2/1971 | Loveland | A44C 5/003 132/294 |
| 9,282,791 | B1 * | 3/2016 | Doherty | A44C 5/0092 |
| 2013/0086943 | A1 * | 4/2013 | Turney | A44C 5/003 63/1.14 |

(Continued)

FOREIGN PATENT DOCUMENTS

| | | | |
|---|---|---|---|
| FR | 9282791 | * | 3/1934 |
| FR | 819512 | * | 4/1936 |

*Primary Examiner* — Cris L. Rodriguez
*Assistant Examiner* — Brianne E Kalach
(74) *Attorney, Agent, or Firm* — Elizabeth Yang

(57) ABSTRACT

A bangle and makeup kit combination assembly and method of operation provide a personal adornment, such as an annular-shaped bangle, that discretely stores and efficiently dispenses individual components of a makeup kit. The assembly comprises a makeup kit comprising multiple makeup components, such as eye and brow liners, trays, mirrors, and a makeup applicator. The assembly further comprises a bangle having an outer ornamental cover that is defined by a decorative surface. The bangle further comprises an outer annular member, a middle makeup retention member having slots that correspond with makeup components, and an inner annular layer. The bangle also includes an edge locking mechanism that secures the annular members and makeup kit components into the ornamental bangle configuration until disassembly for access to the makeup kit is desired. In this manner, the bangle can be worn as an ornament, and then disassembled to access the makeup kit contained therein.

6 Claims, 11 Drawing Sheets

(56) References Cited

U.S. PATENT DOCUMENTS

2015/0359304 A1* 12/2015 Thomas ..... A44C 5/0007
63/1.11
2016/0021991 A1* 1/2016 Franco ..... A44C 5/003
63/1.14

* cited by examiner

BANGLE AND MAKEUP KIT COMBINATION ASSEMBLY

CROSS-REFERENCE TO RELATED APPLICATIONS

This non-provisional application claims priority under 35 U.S.C. § 119(a) on U.S. Provisional Patent Application No. 63/052,732 filed on Jul. 16, 2020, the entire contents of which are hereby incorporated by reference.

FIELD OF THE INVENTION

The present invention relates generally to a bangle and makeup kit combination assembly and method of operation. More so, a combination assembly provides a personal adornment, such as an annular-shaped bangle that discretely stores, and efficiently dispenses individual components of a makeup kit through use of a multilayer configuration of annular members comprising an outer ornamental cover, an outer annular member, a middle makeup retention member having slots that correspond with makeup components, and an inner annular layer; and further including edge locking mechanism that secure the annular members and makeup kit components into the ornamental bangle configuration until disassembly for access to the makeup kit is desired.

BACKGROUND OF THE INVENTION

Cosmetic or makeup containers are women's routine items when needing to make up, refine the make-up, and provides makeup ornaments. A typical cosmetic container comprises some divided cases for different types of cosmetic materials. Therefore, to offer the flexibility and convenience for women carrying, a variety of compact cosmetic containers with individual functions are designed to be on sale in the market. In addition, to satisfy the function of positioning multiple makeup ornaments, some makeup kit cases with different shapes of containers are developed.

However, one of the flaws in current makeup kit cases is that the designs of makeup kit cases or containers have not facilitated users to carry those cases because they are big and heavy. It is well-known that usually, it is exhausting for women to carry the big cases. Also, the big makeup cases themselves are hard to be positioned in an appropriate bag.

Another disadvantage is that users cannot access the makeup easily although the makeup components are positioned well in the divided containers of the cosmetics case assembly. For example, the makeup ornaments in divided cases are not accessible because the disposal and connection between different divisions of the assembly are not designed well.

Therefore, what is clearly needed is a type of makeup kit container that is easy to carry and access makeup for users.

SUMMARY OF THE INVENTION

The object of the present invention is to provide a bangle and makeup kit combination assembly for conveniently carrying and accessing makeup when needed.

In order to achieve the above objectives, accordingly, in an embodiment of the present invention, a bangle and makeup kit combination assembly is provided comprising: a makeup kit having multiple makeup components; a bangle having; an ornamental cover annular member defined by a decorative surface; an outer annular member detachably fitted inside the ornamental cover annular member; a middle makeup retention annular member detachably fitted inside the outer annular member, the middle makeup retention member being defined by at least one slot corresponding to at least one of the multiple makeup components, the middle makeup retention member further being defined by at least one collar corresponding to at least one of the multiple makeup components; and an inner annular member detachably fitted inside the middle makeup retention annular member.

In one embodiment, the bangle further has edge locking mechanisms detachably fitted to the periphery of the ornamental cover annular member, the outer annular member, the middle makeup retention annular member and the inner annular member, the edge locking mechanisms being operable to detachably fasten the annular members and makeup kit components to form the bangle, whereby unfastening the edge locking mechanisms enable access to the makeup kit.

In one embodiment the makeup kit further includes at least one of the following: cream eyeliner with eyeliner applicator, cream brow liner with brow liner applicators, makeup trays, mirrors, and a makeup applicator.

In one embodiment the ornamental cover annular member includes a surface made from at least of one of the following: gold, silver, copper, stainless steel, precious stones, semi-precious stones, synthetic gems, and crystals.

In one embodiment the edge locking mechanism forms a snap-fit relationship with the periphery of the annular members.

In one embodiment the middle makeup retention annular member has an octahedral shape and forms multiple protrusions.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
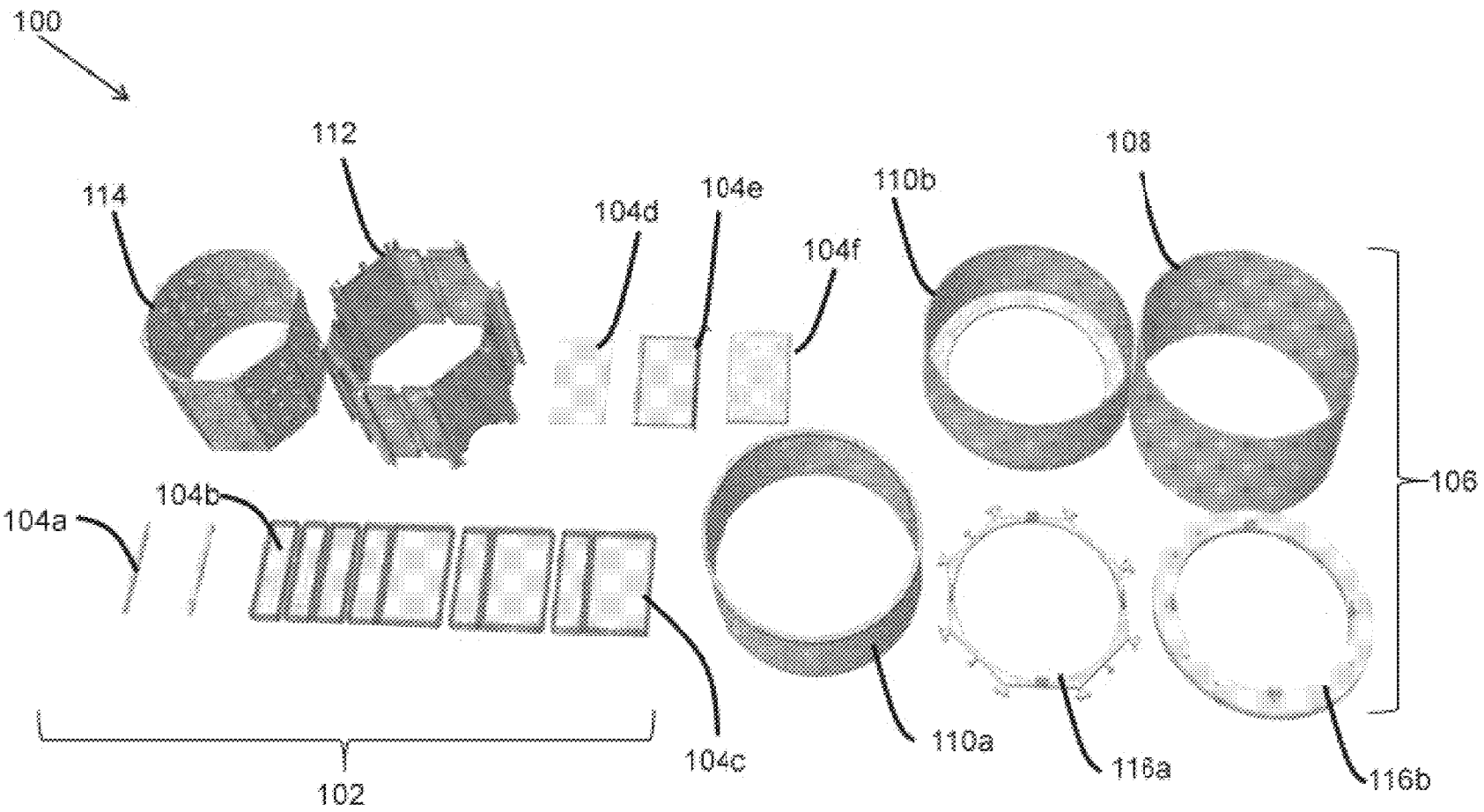
FIG. 1 illustrates a perspective view of an exemplary bangle and makeup kit combination assembly, showing the makeup kit components disassembled from the bangle, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "first," "second," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. § 112.

In one embodiment of the present invention presented in FIGS. 1-11, a bangle and makeup kit combination assembly 100 and method of operation provide a personal adornment, such as an annular-shaped bangle 106, that discretely stores and efficiently dispenses individual components of a makeup kit 102. The bangle 106 and makeup kit 102 combination assembly 100, hereafter "assembly 100" provides a multi-layer configuration of annular members that detachably fit together in an onion-layered configuration.

As referenced in FIG. 1, the assembly 100 comprises a makeup kit 102 comprising multiple makeup components, such as cream eyeliner/cream brow liner, with eyeliner and brow liner applicators 104*a*, makeup trays 104*b*, 104*c*, mirrors 104*e*, and a makeup applicator 104*f*. The assembly 100 further comprises a bangle 106 having an outer ornamental cover that is defined by a decorative surface. The bangle 106 further comprises an outer annular member 110*a*, 110*b*, a middle makeup retention annular member 112 having slots 200 that correspond with makeup components, and an inner annular layer. The bangle 106 also includes an edge locking mechanism 116*a*, 116*b* that secures the annular members and makeup kit 102 components into the ornamental bangle 106 configuration until disassembly 100 for access to the makeup kit 102 is desired. In this manner, the bangle 106 can be worn as an ornament, and then disassembled to access the makeup kit 102 contained therein.

One aspect of a bangle 106 and makeup kit 102 combination assembly 100, comprises:

- a makeup kit 102 having multiple makeup components;
- a bangle 106 having:
  - an ornamental cover annular member 108 defined by a decorative surface;
  - an outer annular member 110*a*, 110*b* detachably fitted inside the ornamental cover annular member 108;
  - a middle makeup retention annular member 112 detachably fitted inside the outer annular member 110*a*, 110*b*, the middle makeup retention annular member 112
  - being defined by at least one slot 200 corresponding to at least one of the multiple makeup components, the middle makeup retention annular member 112 further being defined by at least one collar 202*a*, 202*b* corresponding to at least one of the multiple makeup components; and
  - an inner annular member 114 detachably fitted inside the middle makeup retention annular member 112.

In another aspect, the bangle further has edge locking mechanisms detachably fitted to the periphery of the ornamental cover annular member, the outer annular member, the middle makeup retention annular member and the inner annular member, the edge locking mechanisms being operable to detachably fasten the annular members and makeup kit components to form the bangle, whereby unfastening the edge locking mechanisms enable access to the makeup kit.

In another aspect, the makeup kit 102 includes at least one of the following: cream eye liner with eyeliner applicator and cream brow liner with eyeliner and brow liner applicators 104*a*, makeup trays 104*b*, 104*c*, mirrors 104*e*, and a makeup applicator 104*f*.

In another aspect, the ornamental cover annular member 108 includes a surface made from at least one of the following: gold, silver, copper, stainless steel, precious stones, semi-precious stones, synthetic gems, and crystals.

In another aspect, the edge locking mechanism 116*a*, 116*b* forms a snap-fit relationship with the periphery of the annular members.

In another aspect, the middle makeup retention annular member 112 has an octahedral shape and forms multiple protrusions.

One objective of the present invention is to combine the ornamental aspects of a bangle 106 with a makeup kit 102.

Another objective is to secure the separate components of a makeup kit 102 in a convenient ornament that can be carried on the wrists.

Another objective is to provide a means to easily access makeup.

FIG. 1 references the bangle 106 and makeup kit 102 combination assembly 100, showing the makeup kit components 104*a-f* disassembled from the bangle 106. In some embodiments, the assembly 100 comprises a makeup kit 102 having multiple makeup components. In some embodiments, the makeup kit 102 may include, without limitation, a cream eyeliner/cream brow liner, with eyeliner and brow liner applicators 104*a*, a makeup tray, a mirror, and a makeup applicator 104*f*. The liners may be configured as a cream eyeliner/cream brow liner, with eyeliner and brow liner applicators. In other embodiments, lipstick may replace or be used in conjunction with the cream eyeliner/cream brow liner, with eyeliner and brow liner applicators 104*a*. The makeup tray is configured to carry a shade, a concealer, or other makeups known in the art. The mirror is small, and compact enough to fit in the bangle 106, similar to the other components of the makeup kit 102.

The other component of the present invention is a bangle 106. The bangle 106 is a ring-shaped piece of jewelry that is known in the art to be worn on the wrist. However, in other embodiments, other types of jewelry having a generally annular shape may also be used, such as a bracelet, a necklace, and on a smaller scale, a ring. The bangle 106 is fabricated into multiple annular members that layered onto each other. A middle annular member has slots 200 and collars 202*a*, 202*b* that slidably receive the makeup kit 102 components for storage and dispensing. Furthermore, fastening means secure the layered annular members together. In alternative embodiments, magnets are layered inside the slots. The magnets work to attract the makeup kit components, and thereby create a more secure attachment therein. For example, a makeup tray is fabricated from metal/aluminum, and carries a blush powder. The makeup tray can be slid into the respective slot, and does not slide out due to the magnetic attraction to the metal components of the tray.

Figure 8:
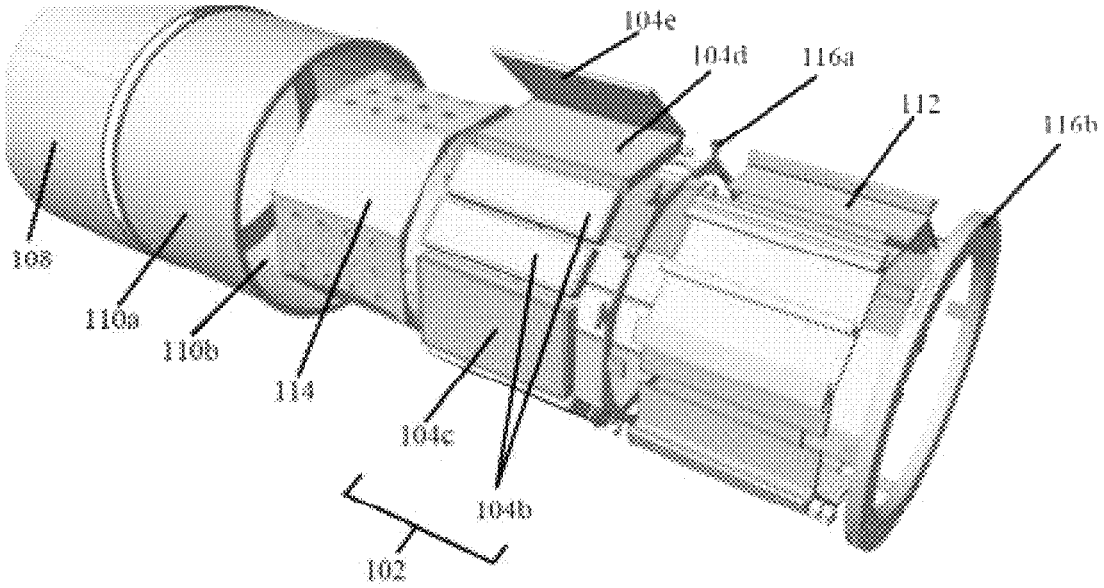
FIG. 8 illustrates an exploded view of the bangle and makeup kit combination assembly, showing the relationship or order of assembly of all the members, in accordance with an embodiment of the present invention.

In one example as shown in FIG. 8, the bangle 106 includes an ornamental cover annular member 108 that is the outermost, visible layer of the bangle 106. The ornamental cover annular member 108 is defined by a decorative surface, such as the gold, stones, etc. However, in other embodiments, the ornamental cover annular member 108 may include, without limitation, gold, silver, copper, stainless steel, precious stones, semi-precious stones, synthetic gems, and crystals. Further, different textures and shapes may be used to provide a greater ornamental effect.

Preferably, the next layer of the bangle 106, is an outer annular member 110*a*, 110*b* that is detachably fitted inside the ornamental cover annular member 108. This can include both a left side 110*a* and a right side 110*b* annular member. The outer annular member 110*a-b* has a slightly smaller diameter than the ornamental cover annular member 108, so as to fit in this layered disposition. This attachment may be a snap fit connection, or may include attachment by sliding grooves, screws, magnets, or cables. However, in other embodiments, the edge locking mechanism 116*a*, 116*b* works to hold the ornamental cover annular member 108, the inner annular member 114, the middle makeup retention annular member 112, the outer annular member 110*a-b* to assemble the bangle 106.

Figure 2A:
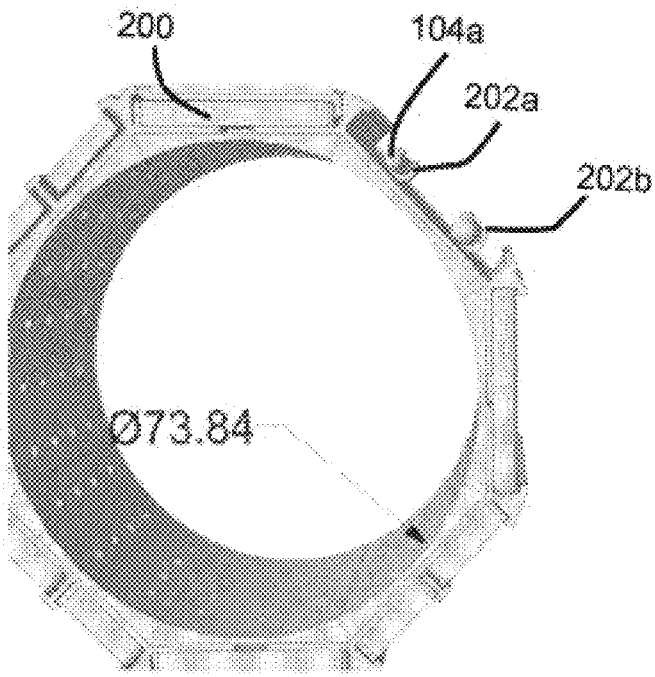
FIGS. 2A-2C illustrates side perspective views of an exemplary middle makeup retention annular member, showing the slots and collars slidably receiving corresponding makeup kit components, in accordance with an embodiment of the present invention.
Figure 2B:
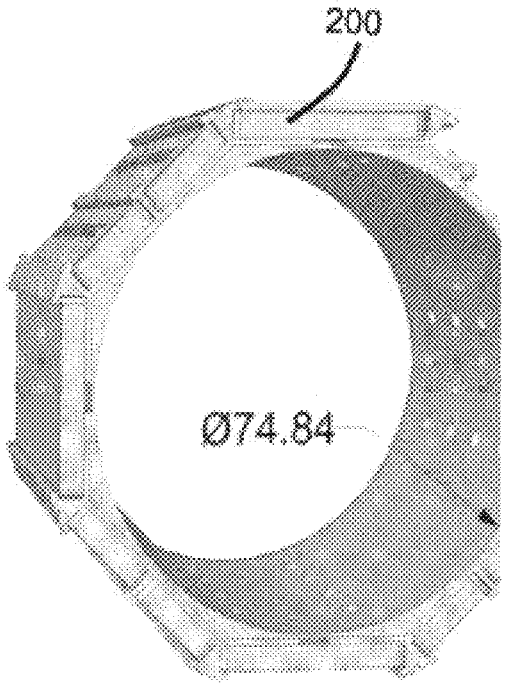
Figure 2C:
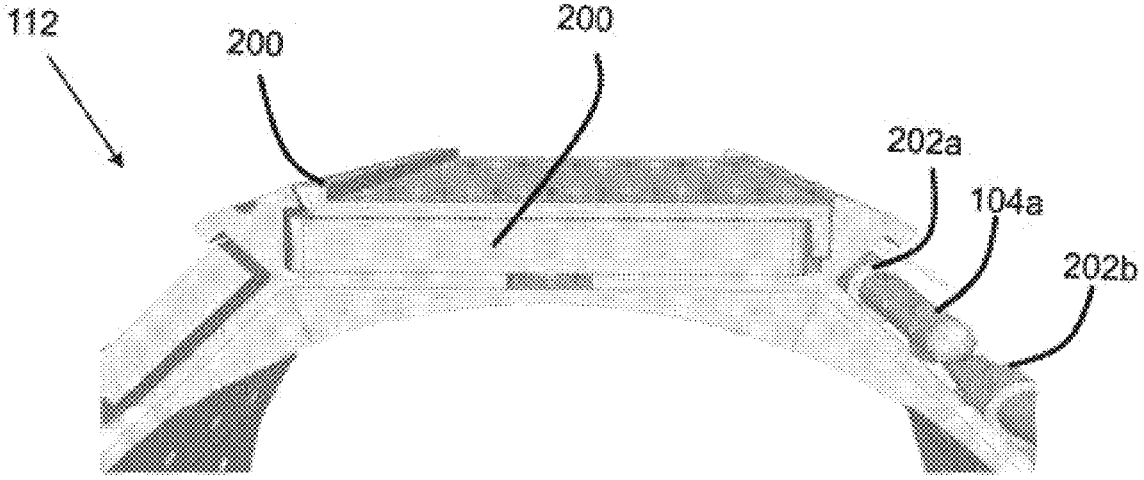

Turning now to FIGS. 2A-2C, combined with FIG. 1, the bangle 106 includes a middle makeup retention annular member 112 that is detachably fitted inside the outer annular member 110*a*, 110*b*. The middle makeup retention annular member 112 has a slightly smaller diameter than the outer annular member 110*a-b*, so as to fit in this layered disposition. Further, the middle makeup retention annular member 112 is the primary component for securely retaining the makeup components. For this function, a series of slots 200 and collars 202*a*, 202*b* form on the outer periphery of the middle makeup retention annular member 112.

For this makeup retention function as shown in FIG. 2A-2C, the middle makeup retention annular member 112 is defined by at least one slot 200 that corresponds to at least one of the multiple makeup components. For example, the slot 200 may have two outer rails that slidably receive a flat, square-shaped makeup component, such as the makeup tray, mirror, and/or makeup applicator 104*f*. Furthermore, the middle makeup retention annular member 112 also has at least one collar 202*a*, 202*b* corresponding to at least one of the multiple makeup components. This may include the cream eyeliner/cream brow liner, with eyeliner and brow liner applicators 104*a*, discussed above. However, any elongated makeup component may be fitted into the collars 202*a-b*. In some embodiments, the collar 202*a-b* has a diameter between 5-15 mm. However, other dimensions may be used.

Continuing with the layered configuration of the bangle 106, an inner annular member 114 is configured to be detachably fitted inside the middle makeup retention annular member 112. The inner annular member 114 has a slightly smaller diameter than the middle makeup retention annular member 112, so as to fit in this layered disposition. In some embodiments, the middle makeup retention annular member 112 has an octahedral shape and forms multiple protrusions. This creates a greater ornamental effect for the bangle 106.

In order to secure the aforementioned annular members together, the assembly 100 provides an edge locking mechanism 116*a*, 116*b* that is detachably fitted to the periphery of the annular members. The edge locking mechanism 116*a-b* detachably fastens the annular members and makeup kit 102 components to form the bangle 106. In this manner, unfastening the edge lock mechanism enables access to the makeup kit 102.

In one embodiment, the edge locking mechanism 116*a-b* forms a snap-fit relationship with the periphery of the annular members. The edge locking mechanism 116*a-b* may also be annular shaped, and have an X-shaped protrusion, a corresponding X-shaped depression, or threaded means to secure to the periphery of the annular members. In another embodiment, a pair of edge locking mechanisms 116*a-b* rotatably fit together to lock onto the edges of the annular members discussed above.

In operation, the edge locking mechanism 116*a-b* is rotated to disassemble the annular members. The middle makeup retention annular member 112 is removed from the other annular members. The desired makeup component is slidably removed from its respective slot 200 or collar 202*a*, 202*b*. After usage, the makeup component is returned to the middle makeup retention annular member 112, and the annular members are once again fastened together in their respective order for donning the bangle 106.

Figure 3A:
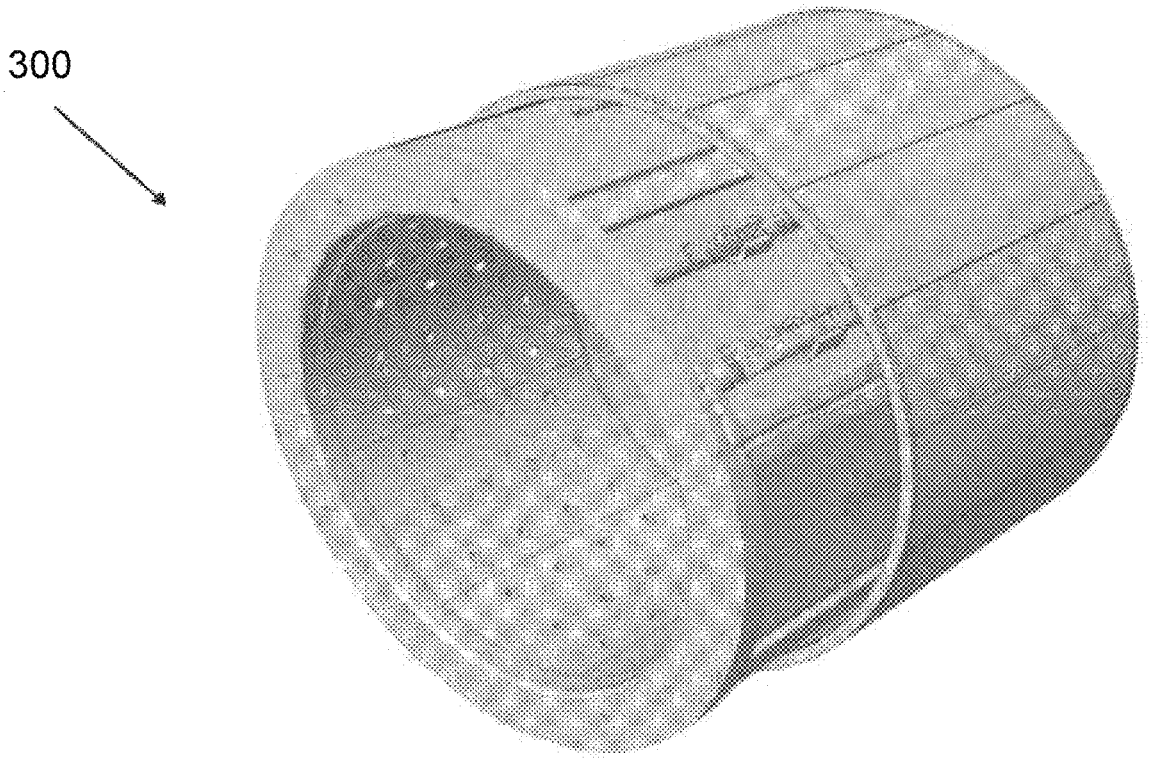
FIGS. 3A and 3B illustrate an alternative embodiment of the bangle, showing the bangle having a cylindrical shape with traversing grooves, in accordance with an embodiment of the present invention.
Figure 3B:
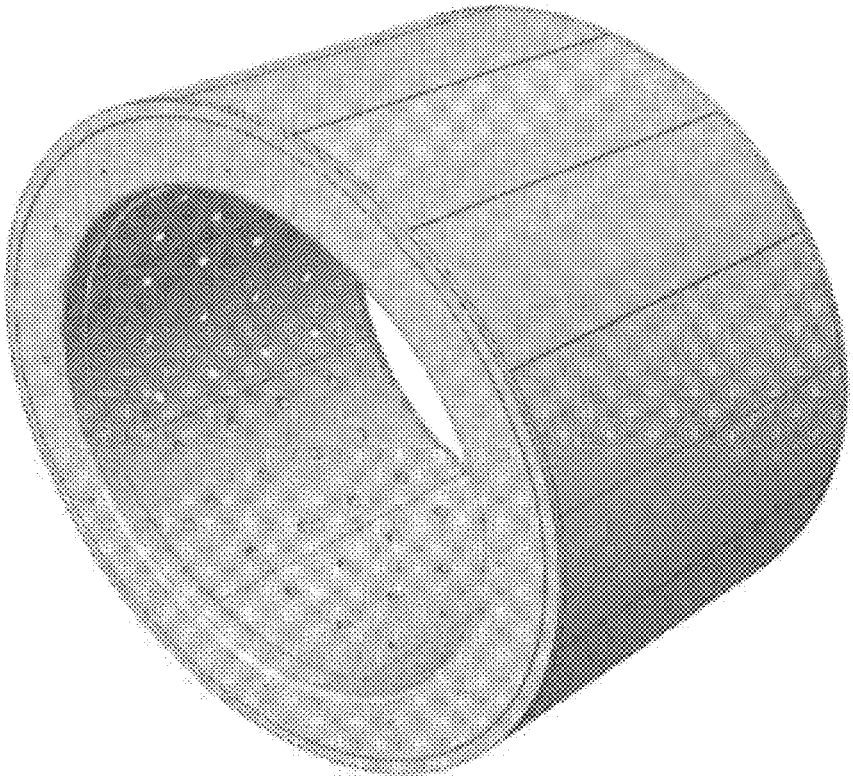
Figure 4A:
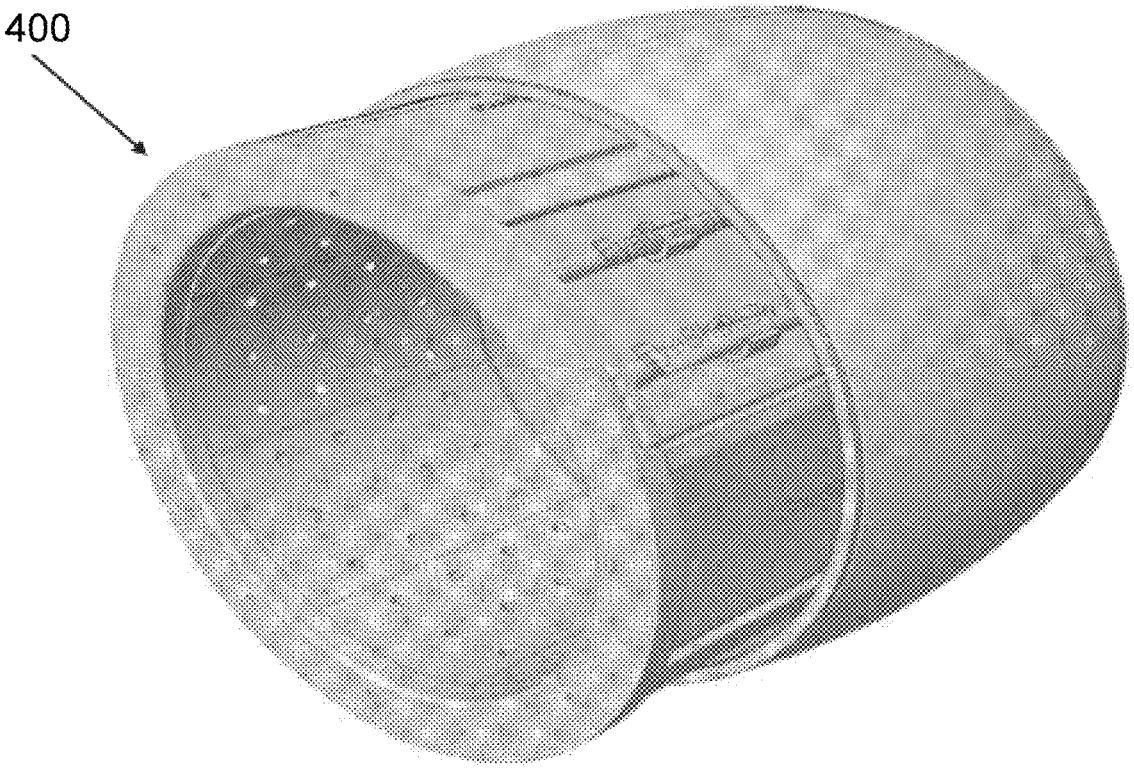
FIGS. 4A and 4B illustrate an alternative embodiment of the bangle, showing the bangle having a convex contour shape, in accordance with an embodiment of the present invention.
Figure 4B:
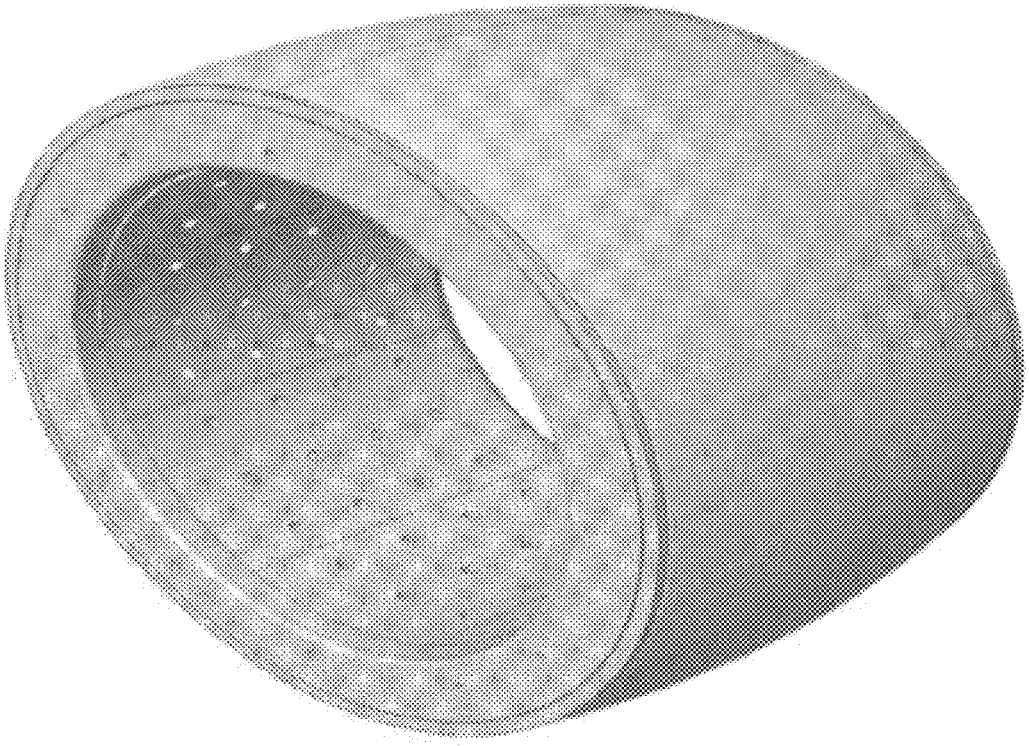
Figure 5A:
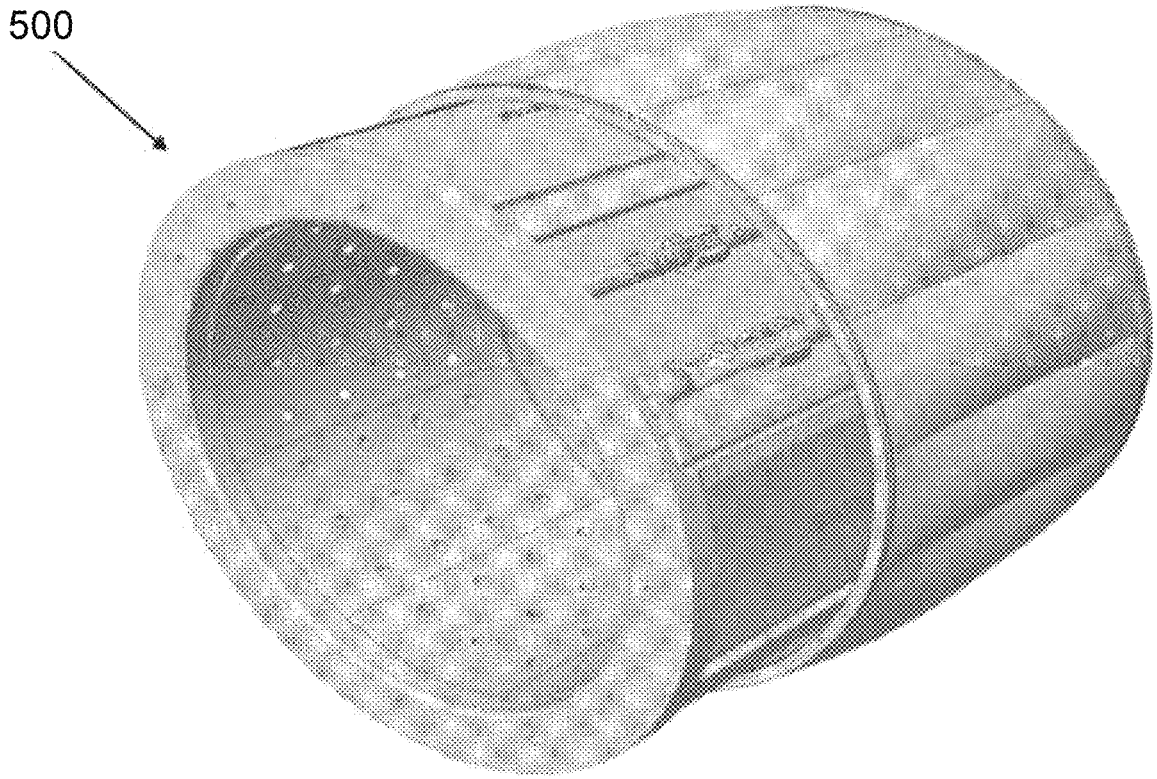
FIGS. 5A and 5B illustrate an alternative embodiment of the bangle, showing the bangle having a convex contour shape with traversing grooves, in accordance with an embodiment of the present invention.
Figure 5B:
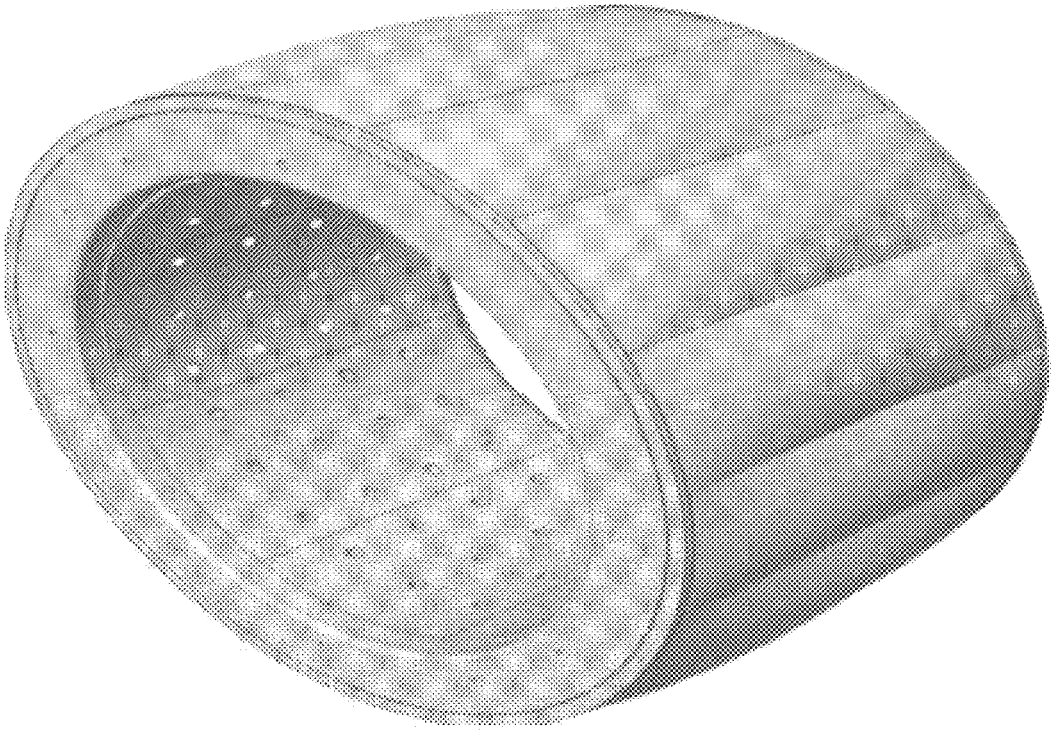
Figure 6A:
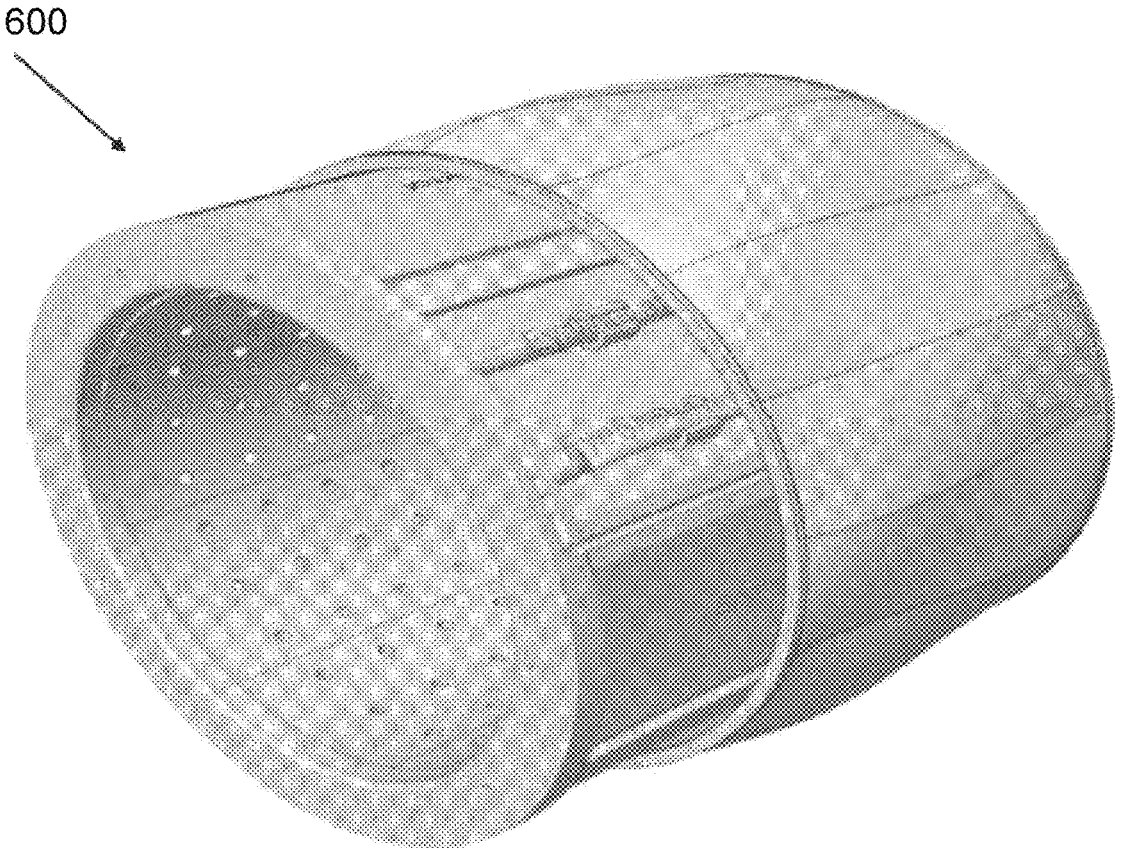
FIGS. 6A and 6B illustrate an alternative embodiment of the bangle, showing the bangle having a wavy contour shape with traversing grooves, in accordance with an embodiment of the present invention.
Figure 6B:
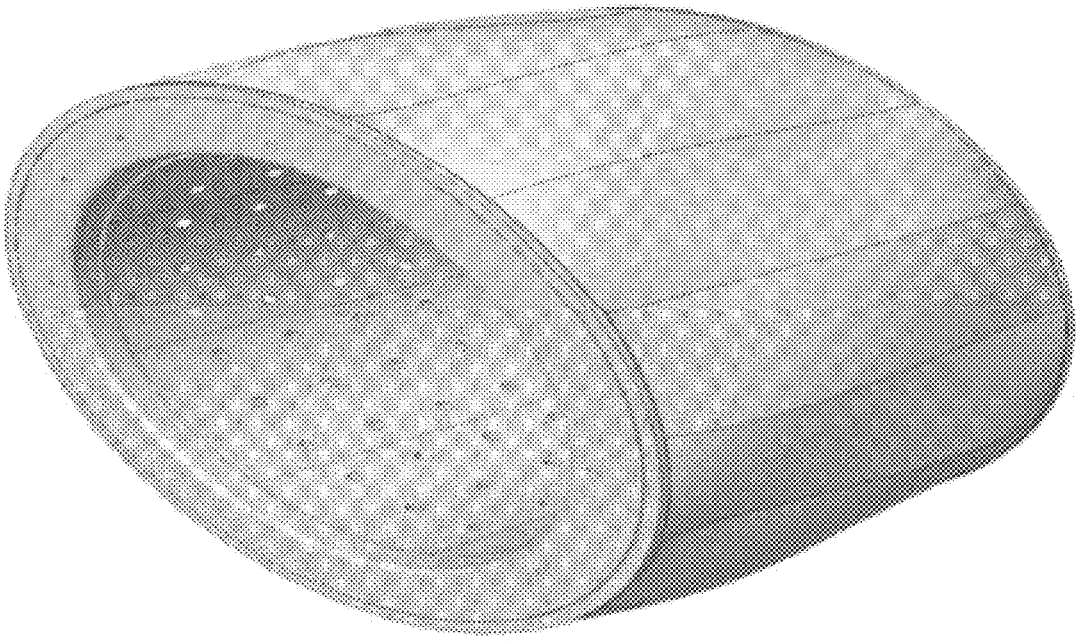

The assembly is also unique in providing various ornamental configurations for the bangle. For example, FIGS. 3A and 3B illustrate an alternative embodiment of the bangle 300, showing the bangle having a cylindrical shape with traversing grooves. In another example, FIGS. 4A and 4B illustrate an alternative embodiment of the bangle 400, showing the bangle having a convex contour shape. In yet another example, FIGS. 5A and 5B illustrate an alternative embodiment of the bangle 500, showing the bangle having a convex contour shape with traversing grooves. In a final example, FIGS. 6A and 6B illustrate an alternative embodiment of the bangle 600, showing the bangle having a wavy contour shape with traversing grooves. However, in other embodiments, any annular/ring-shaped ornamental piece may also be used in place of a bangle for wearing and for retaining the components of the makeup kit.

Figure 7:
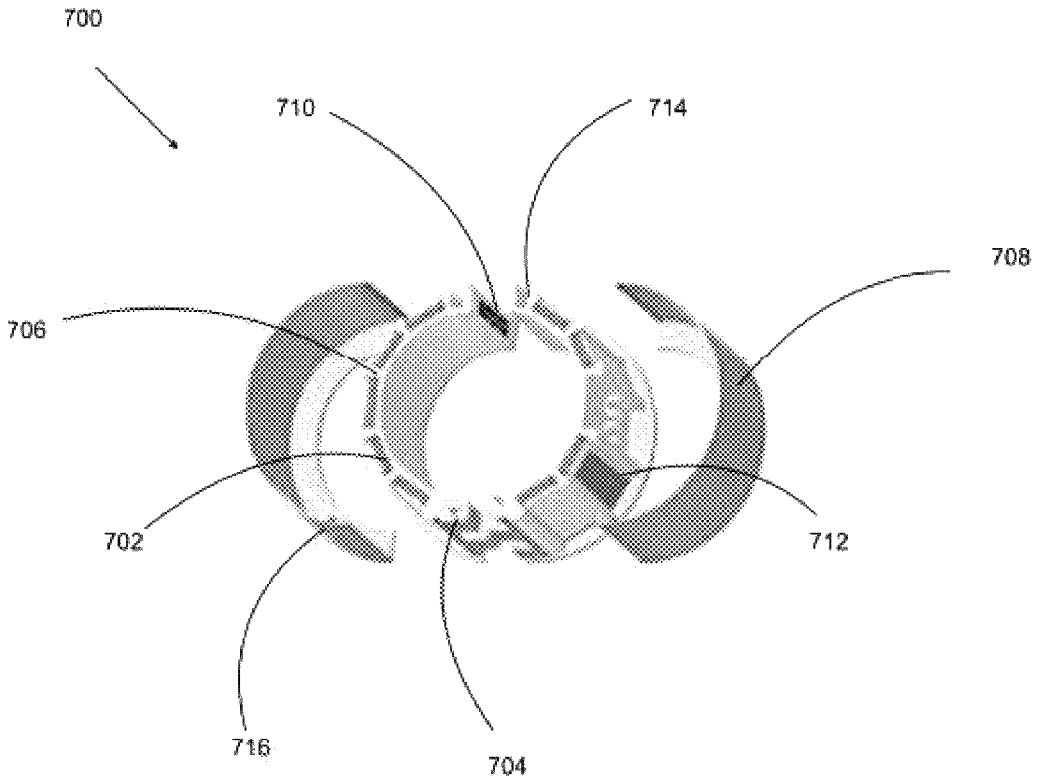
FIG. 7 illustrates a perspective view of an alternative hinged configuration of the bangle and makeup kit combination assembly, showing the annular members hingedly connected and revealing a magnet layered on the inside of the the middle makeup retention annular member, in accordance with an embodiment of the present invention.

In yet another embodiment, shown in FIG. 7, a hinged bangle 700 has multiple annular members that close in to form the bangle 700, and open outwardly to reveal the makeup kit components. The termini of the inner member and the middle makeup retention annular member pivot about a hinge 704 that allows for easy opening and closing to the desired position. An interlocking component 710 utilizes a clamp, snap, magnet, or other friction-fit mechanism to fasten the annular members into a closed, bangle position for wearing. Preferably, the interlocking component 710 are mounted at the end of the middle makeup retention annular member 706 and the inner annular member. To open the bangle 700, the inner annular members and the middle makeup retention annular member are detached at the interlocking component 710. Further, as discussed above, the middle makeup retention annular member 706 contains more than one sheet of magnet 712 that works to attract makeup kit components. The magnet 712 is attached on the surface of the respective slot of the middle makeup retention annular member 706. In an example, a makeup tray 702 slides into the respective slot of the middle makeup retention annular member 706, and remains attached securely therein due to the magnetic attraction of the magnet 712. In the embodiment, the middle makeup retention annular member 706 may contain multiple magnets and slots. Preferably, the middle makeup retention annular member 706 may contain collars with an open to position some makeup pens or sticks, including eyeliner, brow liner, etc.

In an alternative example, the middle makeup retention annular member 706 contains a slideway 714 along the radial direction near the end, and the outer annular member 708 contains a slider bar 716, so that the slider bar 716 can slide along the slideway 714, consequently resulting in the slide-in and slide-out of the outer annular member 708. Preferably, the slideway 714 contains a block at one end to prevent the slider bar 716 from sliding beyond the end of the slideway 714. The block can prevent a complete detachment of the inner and outer annular member of the bangle. More preferably, the slideway 714 is shaped into "T" shape and the slider bar 716 is shaped into "⊥" shape accordingly, thereby allowing the slider bar 716 to stay in the groove of the slideway ("T" shape), consequently securing the position of slider bar 716 and preventing the outer annular member from dropping off. In operation, when the outer annular member slides out, the makeup tray is accessible.

FIGS. 8-11 illustrates some exploded views of the bangle and makeup kit combination assembly, showing the relationship or order of assembly of various members, in accordance with an embodiment of the present invention.

Figure 9:
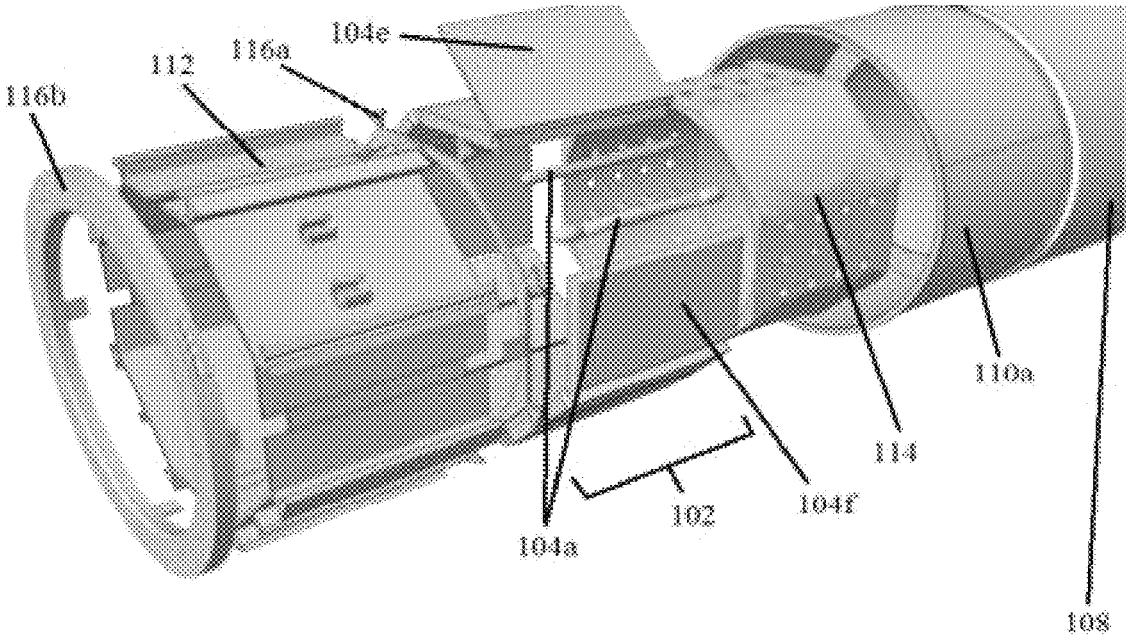
FIG. 9 illustrates another exploded view of the bangle and makeup kit combination assembly, showing the relationship or order of assembly of all the members, in accordance with an embodiment of the present invention.

The connection and position of all the members, including multiple makeup components, various annular members, and edge locking mechanisms, are illustrated visibly in FIGS. 8-9. All the makeup components are positioned well in this assembly, and all the members are fitted into each other well to establish a stylish and applicable bangle in which the makeup components are positioned well.

Figure 10:
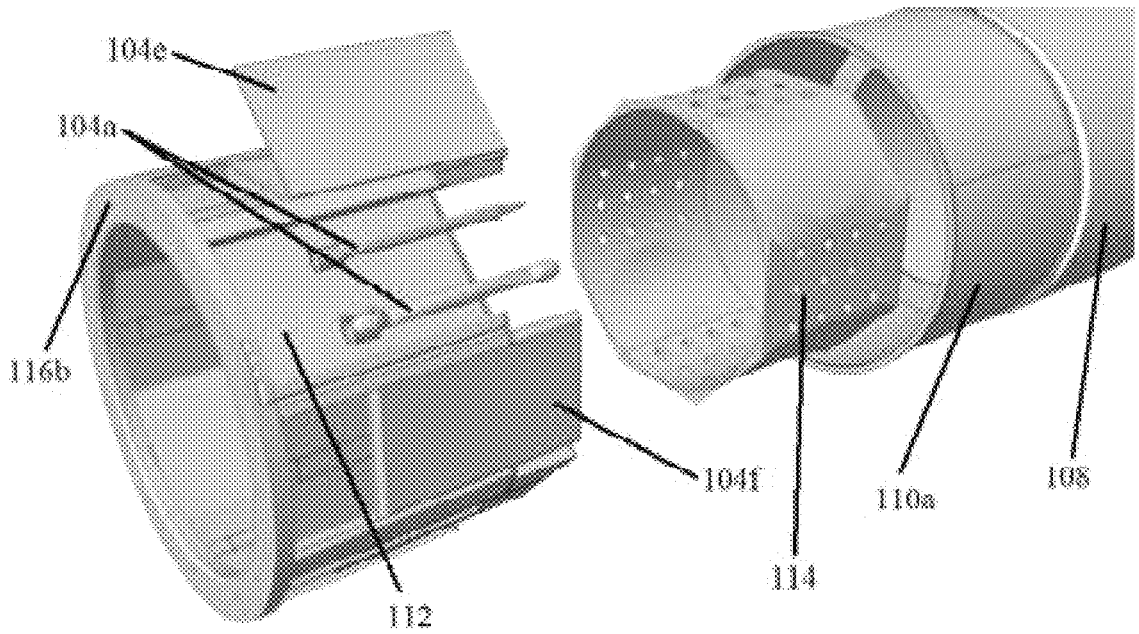
FIG. 10 illustrates another exploded view of the bangle and makeup kit combination assembly, showing the relationship or order of assembly of various annular members, multiple makeup components, and edge locking mechanism, in accordance with an embodiment of the present invention.
Figure 11:
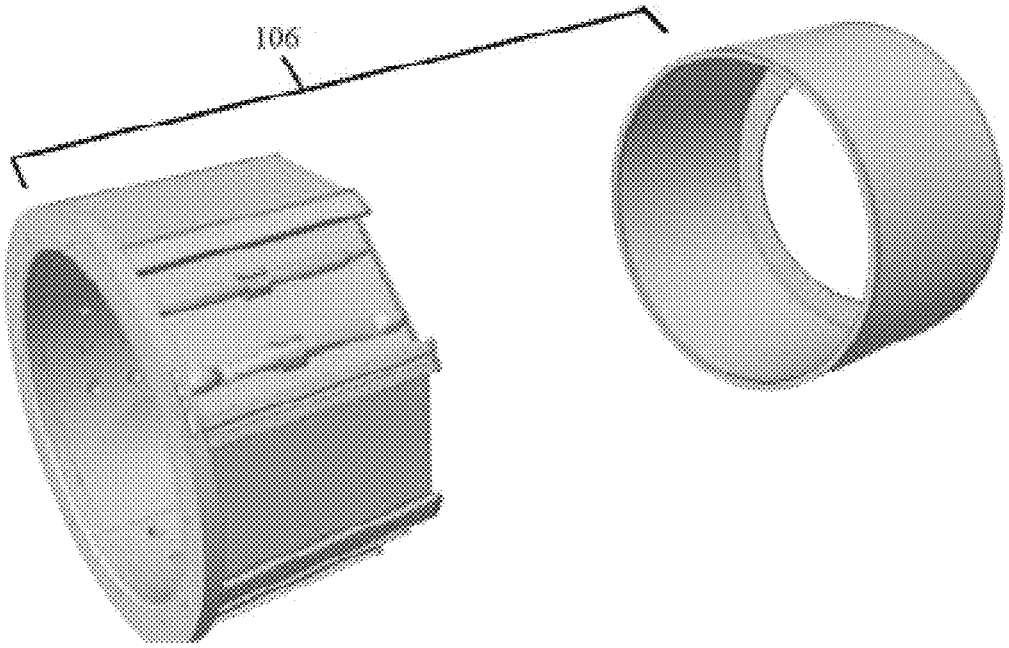
FIG. 11 illustrates another exploded view of the bangle and makeup kit combination assembly, showing the relationship or order of the bangle of various annular members and edge locking mechanism, in accordance with an embodiment of the present invention.

Likewise, FIGS. 10-11 substantially indicate the connection and order of inner/out annular members and edge locking mechanism after the assembly of members or parts of members. Via the well-designed members and skillful configuration, the present invention has solved the preexisting and lasting problems in prior arts, i.e. not easily accessible to makeup or makeup case being big and heavy.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A bangle and makeup kit combination assembly, comprising:

a bangle comprising:

an annular ornamental cover member defined by a decorative surface;

an annular outer member;

an annular middle member detachably secured inside the outer member, the middle member defined by left and right halves connected at their respective proximal ends by a rotatable hinge and removably securable to one another at their respective distal ends to form an annular shape; at least one of the left or right halves comprising at least one slot configured to removably receive a makeup tool and further comprising at least one collar configured to removably receive a complimentary shaped makeup component; and an annular inner member detachably fitted inside the middle member, the inner member comprising a left and right portion hingedly attached at their respective proximal ends, wherein the left and right portions form an annular shape when their respective proximal ends are removably secured to one another via a removable connector;

wherein the bangle further comprises an edge locking mechanism configured to detachably secure to a periphery of each of the outer member, the middle member and the inner member, while the outer member and middle member are sandwiched between the inner and cover members to form an assembled state of the bangle with at least one makeup component secured to the middle member within.

2. The assembly of claim 1, wherein the makeup kit includes at least one of the following: cream eyeliner with eyeliner applicator, cream brow liner with brow liner applicators, makeup trays, mirrors, and a makeup applicator.

3. The assembly of claim 1, wherein the edge locking mechanism form a snap-fit relationship with the periphery of each of the cover, outer, middle and inner members.

4. The assembly of claim 1, wherein the middle member has an octahedral shape and forms multiple protrusions.

5. The assembly of claim 1, wherein the ornamental cover includes a surface made from at least one of the following: gold, silver, copper, stainless steel, precious stones, semi-precious stones, synthetic gems, and crystals.

6. The assembly of claim 1, wherein the middle member contains a slideway along a radial direction near an edge of the middle member, and the outer member contains a slider bar.

* * * * *